US007181941B2

(12) United States Patent
Eden, Jr.

(10) Patent No.: US 7,181,941 B2
(45) Date of Patent: Feb. 27, 2007

(54) LOCK SYSTEM WITH IMPROVED AUXILIARY PIN TUMBLER STACK

(75) Inventor: Charles W. Eden, Jr., Lewisville, NC (US)

(73) Assignee: Kaba Ilco Corp., Winston-Salem, NC (US)

( * ) Notice: Subject to any disclaimer, the term of this patent is extended or adjusted under 35 U.S.C. 154(b) by 0 days.

(21) Appl. No.: 10/909,567

(22) Filed: Aug. 2, 2004

(65) Prior Publication Data

US 2006/0021405 A1 Feb. 2, 2006

(51) Int. Cl.
*E05B 19/06* (2006.01)
*E05B 29/04* (2006.01)

(52) U.S. Cl. ..... 70/493; 70/409

(58) Field of Classification Search ..... 70/389, 70/390, 429, 409, 493–495, 419, 358, 492, 70/378, 392, 405–407, DIG. 23
See application file for complete search history.

(56) References Cited

U.S. PATENT DOCUMENTS 4,235,086 A * 11/1980 Genakis ..... 70/494
4,450,699 A * 5/1984 Genakis ..... 70/494
4,667,495 A * 5/1987 Girard et al. ..... 70/398
4,823,575 A 4/1989 Florian et al.
5,016,455 A 5/1991 Hennessy
5,076,081 A * 12/1991 Boris, Jr. ..... 70/398
5,101,648 A * 4/1992 Kuster ..... 70/358
5,131,249 A * 7/1992 Baden et al. ..... 70/398
5,222,383 A * 6/1993 Fann et al. ..... 70/358
5,361,614 A * 11/1994 Metcalf ..... 70/389
5,533,369 A * 7/1996 Valdajos-Gallego ..... 70/493
5,839,308 A * 11/1998 Eizen et al. ..... 70/358
6,125,674 A * 10/2000 Aramburu ..... 70/358
6,257,033 B1 * 7/2001 Ziv-Av ..... 70/494
6,508,091 B1 * 1/2003 Donatini ..... 70/359

* cited by examiner

*Primary Examiner*—Lloyd A. Gall
(74) *Attorney, Agent, or Firm*—Alix, Yale & Ristas, LLP

(57) ABSTRACT

In a pin tumbler-type cylinder lock having an auxiliary tumbler stack, the bottom pin of the auxiliary tumbler stack has a recessed underside for receiving a projection on the key to form a detent. The invention provides an additional functionality that has not previously been associated with the auxiliary tumbler stack. When the projection on the key as seated, it prevents the key from being withdrawn from the keyway while the plug is in any rotational position in which the drive and bottom pins are not substantially aligned. Thus, the key is retained whenever the plug has been rotated.

47 Claims, 10 Drawing Sheets

LOCK SYSTEM WITH IMPROVED AUXILIARY PIN TUMBLER STACK

BACKGROUND OF THE INVENTION

1. Field of the Invention

The present invention relates generally to pin tumbler-type cylinder locks and associated keys. More particularly, this invention is directed to enhancing the security afforded by cylinder locks and especially to enhancing the ability of such locks to resist operation by a key obtained from an unauthorized source.

2. Description of the Prior Art

U.S. Pat. No. 4,823,575 discloses a novel cylinder lock and an associated key. The patented key, in addition to conventional bitting, is provided with a pair of projections on the opposite edges of the blade. These projections perform the dual function of operating an auxiliary pin tumbler stack, to permit rotation of the key and plug relative to the shell, and retaining the key in the keyway. The unique manner of implementation of the key retention function also reduces key and lock wear when force is imparted to the inserted key to move the door in which the lock is installed. U.S. Pat. No. 4,823,575 depicts a key wherein the bitting is in the form of depressions formed in the key blade, i.e., the patent depicts a "Kaba" type key. It will be understood by those skilled in the art, however, that the patented invention is equally applicable to a key wherein the bitting is, again by way of example only, in the form of conventional serrations in one or both edges of the key blade. Additionally, the patent depicts a reversible key, i.e., a key wherein the bitting is symmetrical and the two projections are of substantially the same size and shape. It will also be obvious to those skilled in the art that the patented invention is applicable to a key and lock combination where the pin tumbler arrangement is not symmetrical and where the projections serve separate and discrete functions, i.e., one projection operates the auxiliary pin tumbler stack while the other projection is intended for key retention only.

The lock and key of U.S. Pat. No. 4,823,575 have enjoyed significant commercial success. The patented combination, however, lacks a capability which many purchasers of high security locks desire. This capability is known in the art as "trapping". With trapping capability, should an attempt be made to operate a lock with an unauthorized key, such key is captured in the lock if the attempt to rotate the plug relative to the shell proves successful. A "trapped" key may not be withdrawn from the keyway without disassembly of the lock and trapping will prevent further plug rotation.

U.S. Pat. No. 5,016,455 is directed to an improvement to the lock and associated key of U.S. Pat. No. 4,823,575 and particularly adds a trapping function. The cylinder lock is characterized by two separate parting lines, and particularly two shear lines located at different radial distances from the axis of the shell. The primary pin tumbler stacks are associated with a first of these parting lines while an auxiliary pin tumbler stack is associated with the second parting line. The second parting line is located at a greater radial distance from the cylinder lock axis than the first parting line. The shell of the lock has portions of at least two different diameters, commensurate with the two parting lines, and the plug has a shape which is, in two portions, complementary in shape to the shell. A circumferential retaining groove is formed in that portion of the shell which is associated with the auxiliary pin tumbler stack. A longitudinal slot or recess having the same depth as the groove communicates between the forward end of the shell and the groove. An associated key has, in addition to conventional bitting for operating the primary pin tumbler stacks, a pair of projections extending from the opposed edges of the key blade. These projections are, at least in part, in alignment. A first projection causes translation of the auxiliary pin tumbler stack to permit rotation of the plug relative to the shell. The second projection is longer than the first projections and will pass along the longitudinal slot to engage the groove to retain the key in the plug subsequent to rotation thereof. The second projection also cooperates with the drive pin of the auxiliary pin tumbler stack, upon rotation of the plug by 180 degrees, to prevent the driver pin from engaging the keyway in the plug, such engagement trapping the key and disabling the lock.

SUMMARY OF THE INVENTION

The present invention is an improvement over the lock and key described in U.S. Pat. No. 5,016,455, the disclosure of which is hereby incorporated by reference. According to the present invention, the bottom pin of the auxiliary stack has a recessed underside for receiving a projection on the key to form a detent.

During insertion of the key in the keyway, the key projection cams and displaces the bottom pin to align the shear line between the bottom pin and the drive pin, with the shear line between the plug and the shell, at the location of the auxiliary stack. The key projection enters into and preferably seats in the recess. An improperly milled projection will not displace the bottom pin the correct distance, and thus not effectuate the correct alignment of the shear lines, so the plug cannot be fully rotated to operate an associated latch or the like. This aspect of the invention provides auxiliary security functionality to the main key bitting and associated main tumbler stack.

The invention provides an additional functionality that has not previously been associated with the auxiliary tumbler stack. The projection on the key seated in the recess in the bottom pin prevents the key from being withdrawn from the keyway while the plug is in any rotational position wherein the drive and bottom pins are not substantially aligned. Thus, the key is retained whenever the plug has been rotated.

The dual functionality of the auxiliary stack according to the invention provides several advantages. When the invention is employed with the bottom pin and associated groove configuration described in U.S. Pat. No. 5,016,455, the lock has redundant and diverse key retention. Alternatively, the invention may be implemented so that only the invention provides the key retention functionality. In this embodiment, the lower projection on the key is flush with the plug outer surface and the internal surface of the shell at the shell axial location of the auxiliary stack, does not have a groove for the lower projection on the key. This simplifies manufacture of the shell and assembly of the lock. Finally, the dual functionality of the invention as achieved in the auxiliary stack, could also be implemented in other lock configurations that may not require the presence of a lower projection on the key in order to maintain a clear shear line when the plug has been rotated 180 degrees.

In another aspect, the invention is directed to a key blank for a cylinder lock comprising a bow; and a blade longitudinally extending from the bow. The blade a has a pair of longitudinally extending oppositely disposed and spaced edges, and side faces which connect the edges. A projection extends outwardly from each of the oppositely disposed edges, and the projections are at least in part in alignment.

One of the projections, for interacting with the bottom auxiliary pin, preferably has a compound convex profile, providing a longitudinal cam profile for lifting the pin during insertion and withdrawal of the key from the key way, and a transverse profile that enables the projection to fully enter and center within the recess in the auxiliary bottom pin. The projections, especially the one for interacting with the auxiliary bottom pin, require careful milling and would be fabricated as a key blank by the key manufacturer.

BRIEF DESCRIPTION OF THE DRAWINGS

The present invention may be readily understood, and its numerous objects and advantages will become apparent to those skilled in the art, by reference to the accompanying drawings wherein like reference numerals refer to like elements in the figures and wherein.

DESCRIPTION OF THE DISCLOSED EMBODIMENT

The context of the present invention will be described with reference to the known lock and key system shown in FIG. 1, whereas the particular inventive features will be described with respect to FIGS. 2–11.

Figure 1:
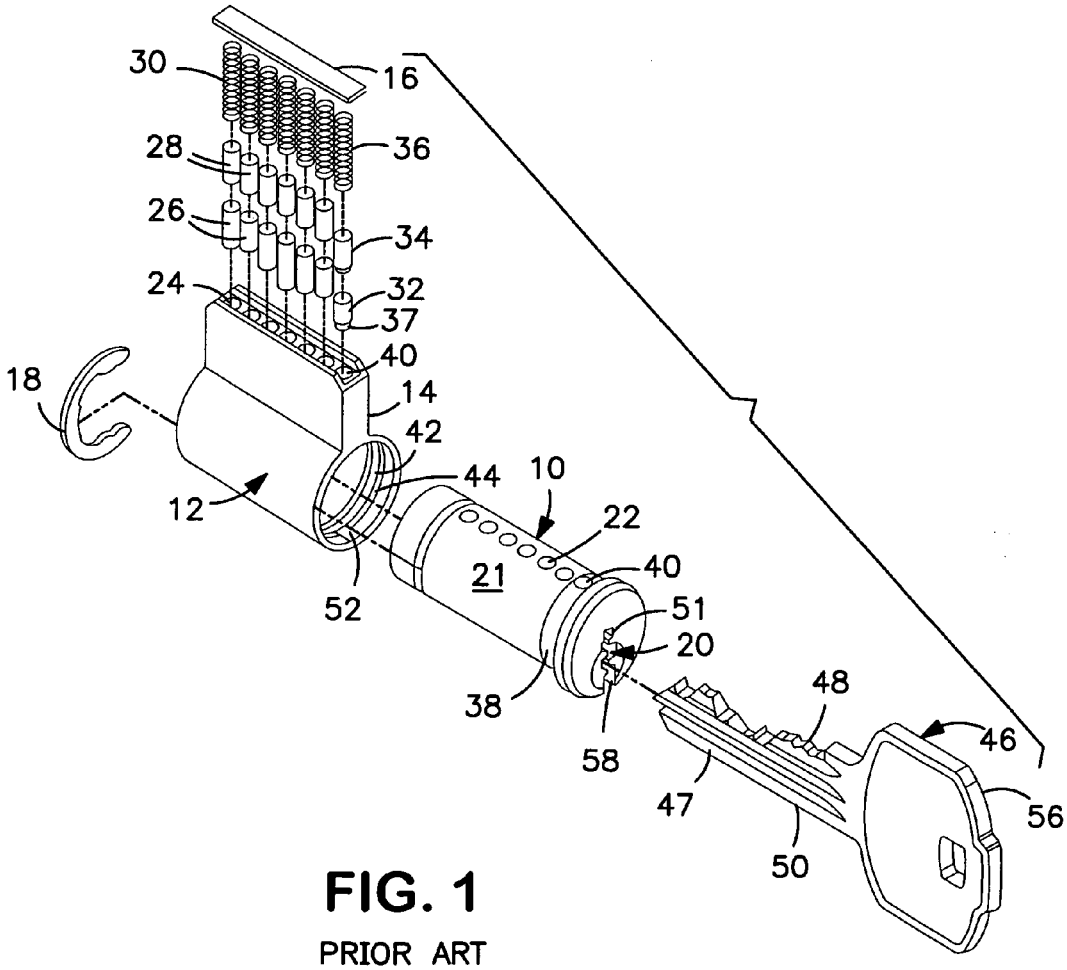
FIG. 1 PRIOR ART
FIG. 1 is an exploded perspective view of a cylinder lock and key according to U.S. Pat. No. 5,016,455.

The cylinder lock system shown in FIG. 1 includes a plug and a shell, respectively indicated generally at 10 and 12. The lock is of the type known in the art as a "bible" lock, i.e., the single row of pin tumbler stacks with their associated biasing springs are received in chambers provided in a generally rectangular projection 14 which extends from shell 12. The pin tumbler stacks and springs are retained in the "bible" 14 by means of a plate 16, the plate 16 being affixed to the bible 14 in any suitable manner. The plug 10 is captured in the shell 12 by means of a spring-loaded lock ring 18.

It is to be understood that such construction exemplifies that employed in conventional cylinder locks, wherein the plug 10 is provided with a keyway, indicated generally at 20, and has a cylindrical intermediate portion 21 in which a spaced row of bores 22 are formed. The bores or pin chambers 22 extend inwardly to intersect the keyway. The "bottom" pins 26 of the primary pin tumbler stacks are received in chambers 22. With the lock in the locked condition, the individual chambers 22 of the linear array of pin chambers in plug 10 will each be aligned with a bore which defines a pin tumbler chamber 24 in bible 14. Chambers 24 receive the driver pins 28 of the primary pin tumbler stacks. In the disclosed embodiment each of the primary pin tumbler stacks comprises a "bottom" pin 26, a "top" or driver pin 28 and a biasing spring 30. When the lock is in the locked condition, and a proper key is not inserted in the keyway 20 in plug 10, the spring biased driver pins 28 are positioned such that they extend across the shear line between the plug and shell and rotation of the plug relative to the shell is thus prevented. Insertion of a proper key results in translation of the pin tumbler stacks to place the interface or shear line between the bottom and driver pins at the shear line between the plug and shell and rotation of the plug with the bottom pins is possible.

Figure 2:
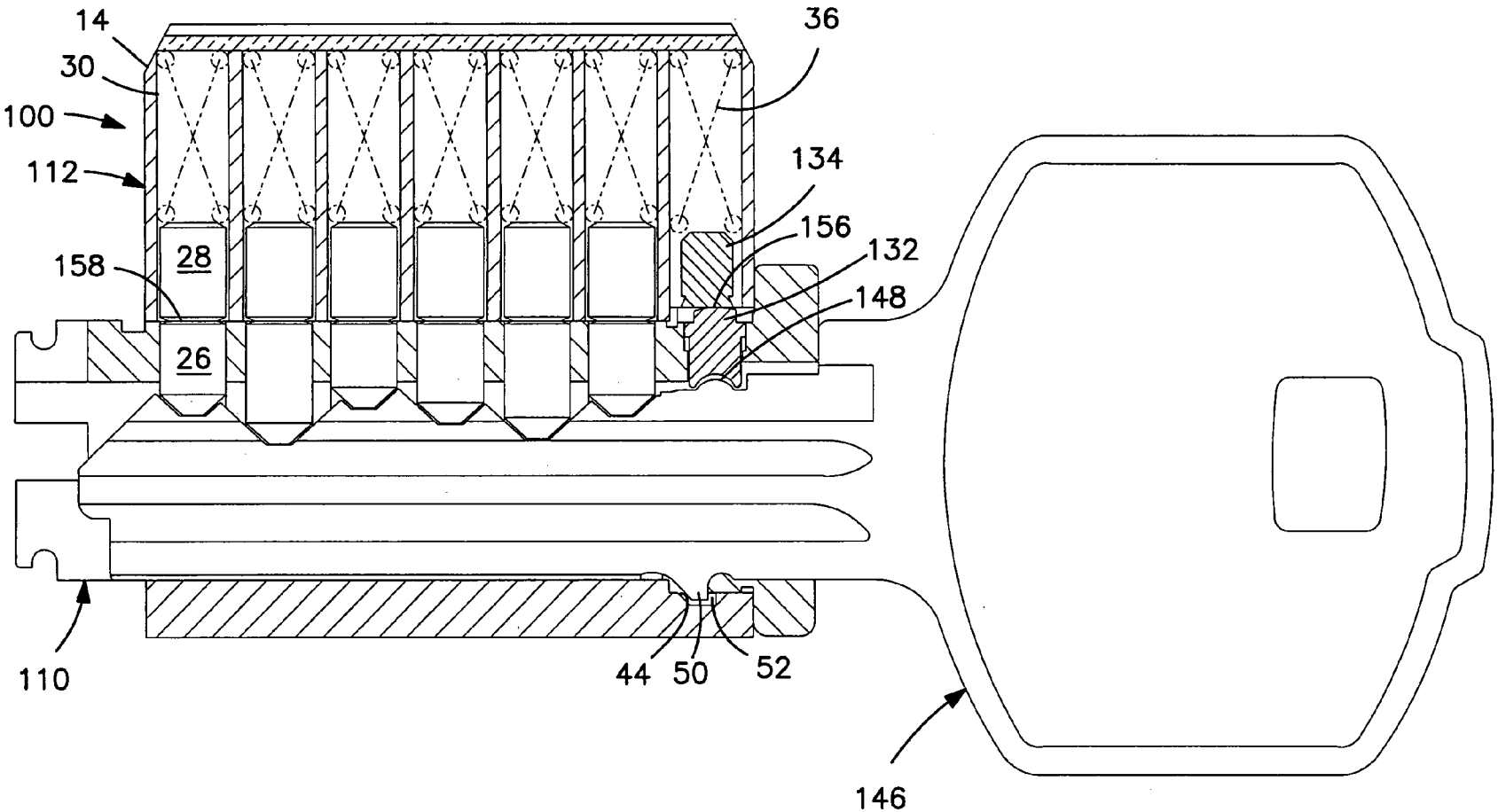
FIG. 2 is a cross-sectional, side elevational view of the present invention, showing the improvements relative to the lock and key of FIG. 1, the key not being shown in cross-section in FIG. 2 in the interest of facilitating understanding of the invention.

The lock is provided with an auxiliary pin tumbler stack, which comprises a bottom pin 32, a driver pin 34 and a biasing spring 36. The plug 10 is provided with a forwardly disposed cylindrical portion 38 of increased diameter relative to the cylindrical intermediate portion 21 in which the pin chambers 22 are formed. The chamber 40 which receives the bottom pin 32 of the auxiliary pin tumbler stack is formed in enlarged diameter portion 38 of the plug and, as with chambers 24, extends inwardly to intercept the keyway. The shell 12 is provided with a recess 42 which is complementary in size and shape to, and which thus receives, the enlarged diameter portion 38 of plug 10. Recess 42 extends inwardly from the forwardly facing end of shell 12 to a stop or guide shoulder. A circumferential groove 44 is provided intermediate the width of recess 42. Groove 44, as may be seen from FIG. 2, is defined by a front shoulder, which extends generally radially with respect to the axis of the cylindrical shell, and an angled rear surface.

The key 46 is provided with bitting and a pair of oppositely disposed projections which extend from the edges of blade 47. The bitting in the disclosed embodiment is in the form of a conventional sawtooth cut. In the case of the "bible" lock that has been depicted for purposes of explanation, the bitting is on a single edge of the key. The projections are indicated at 48 and 50. The projection 48 operates, i.e., cams, the auxiliary pin tumbler stack when the key is inserted in the plug keyway. Projection 48 is provided with angularly oriented cam surfaces on all four sides and may, again by way of example, have a truncated pyramidal shape. The key blade 47 is provided with a longitudinally extending undercut, not shown, which results in one side of projection 48 extending outwardly from the base of the cut and then inwardly to its top surface. Keyway 20 is provided with an upper portion 51 shaped and sized to receive projection 48. When compared to a conventional lock, in order to accommodate projection 48, the keyway 20 is of extended height for a portion of its length which extends across the auxiliary pin tumbler receiving bore 40. As noted above, that portion of keyway 20 which is of extended height is also shaped as necessary to accommodate the projection 48.

In the conventional manner, the keyway 20 extends through the bottom of plug 10 as shown at 58. The shell 12 is provided, extending inwardly from the forwardly facing edge thereof, with a recess 52 that receives the projection 50 on the key blade. Recess 52 is oriented transversely with respect to the front shoulder of groove 44 and terminates at a point located inwardly beyond the intersection of the recess with groove 44.

According to the present invention, the bottom pin 32 of the auxiliary pin tumbler stack and the associated projecting cam 48 shown in FIG. 1, are redesigned as shown in FIGS. 2–11. The redesigned bottom pin 32 is identified by numeric identifier 132 and the redesigned cam projection is identified by numeric identifier 148. Preferably, the driver pin 34 is also redesigned, as indicated by numeric identifier 134. This driver pin 134 can be of smaller diameter than the other driver pins in the bible, to assure that the pin will cross the shear line if an unauthorized key is used to rotate the plug within the shell, as described below.

A significant aspect of the present invention is that the lower surface 150 of the bottom pin 132 has a recess, such as a concave cavity, for receiving and seating the projecting convex cam 148 on the key. This is evident in FIGS. 3 and 9, where a properly milled projection 148 is received within the pin 132, such that the interface between the top surface 152 of the pin 132 and the bottom surface 154 of the drive pin 134 is at the shear line 156 between the plug 110 and the shell 112. As shown in FIG. 2, this shear line 156 for the auxiliary stack, is preferably at a greater diameter than the shear line 158 for the remainder of the stacks in the bible 14. Moreover, the axis of the auxiliary bore or chamber of the drive pin 134 is slightly offset from the axis of the bore or chamber of the bottom pin 132 (and the center of the projection 148 of the key) along the plug axis direction, such that the centerline 160 of the bottom pin 132 and the projection 148 are nominally aligned but offset from the centerline of the drive pin 134. This provides additional flexibility in designing a lock/key combination that is resistant to unauthorized access, provided the chambers and pins are sized and or shaped to accommodate each other when activated by a properly milled key.

Figure 3:
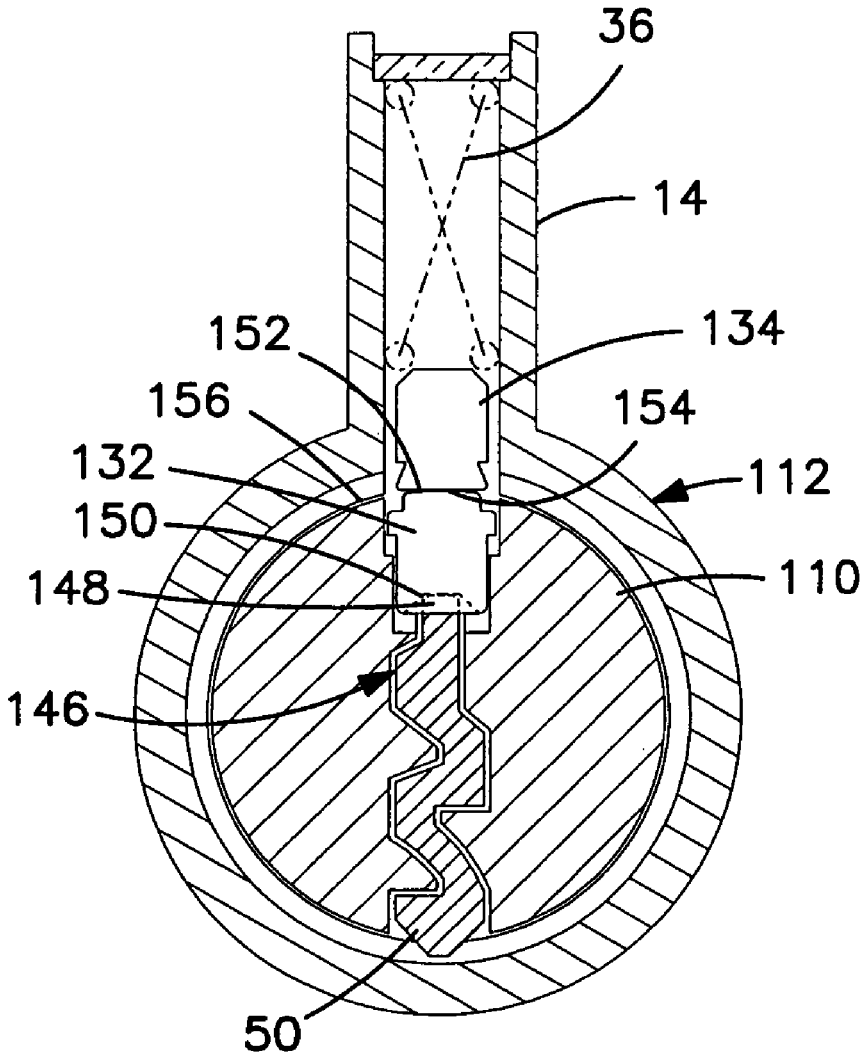
FIG. 3 is a cross sectional view along line 3—3 of FIG. 2, showing a properly milled key in the neutral position.
Figure 4:
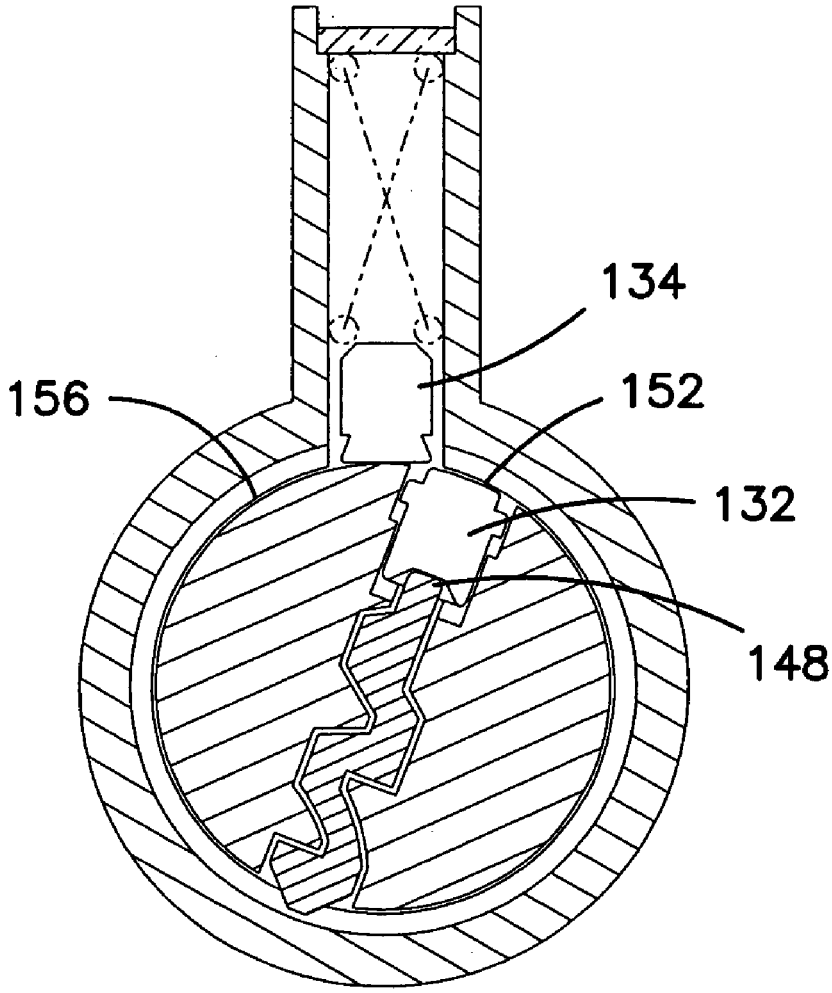
FIG. 4 is a cross sectional view of the lock and key of FIG. 3, with the key rotated slightly clockwise, yet maintaining a clear shear line that permits further rotation.
Figure 5:
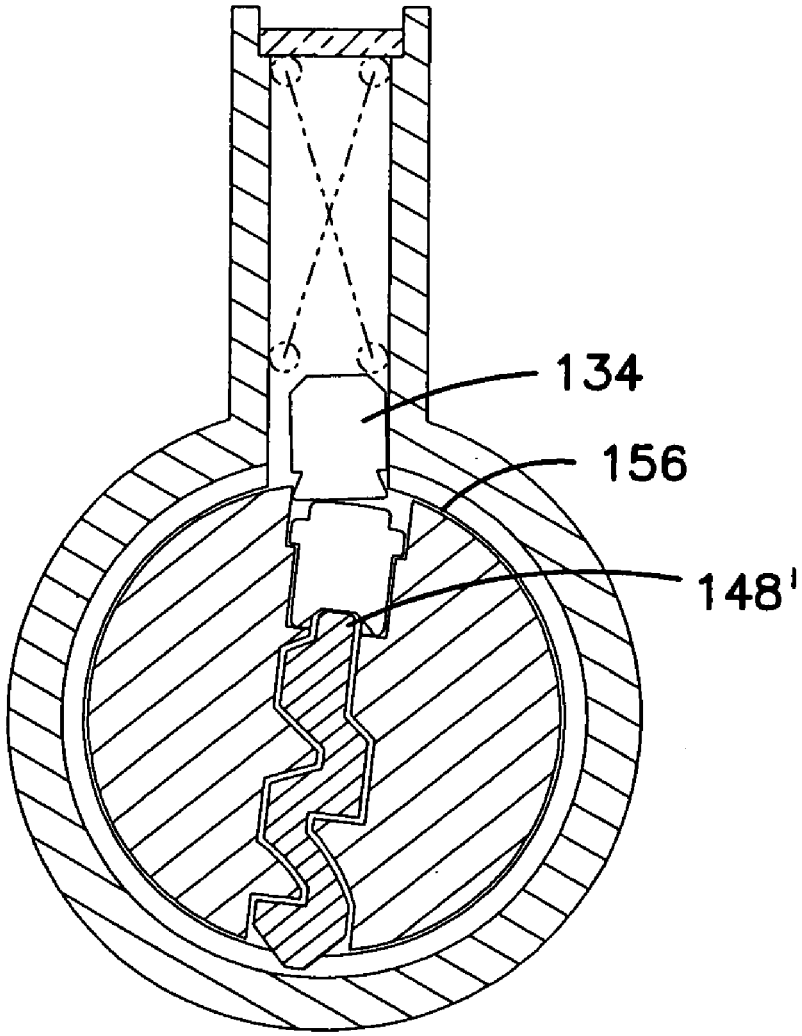
FIG. 5 is a cross sectional view of the lock of FIG. 2, but with a first type of improperly milled key rotated slightly clockwise, whereby the shear line is crossed, thereby preventing further rotation and trapping the key
Figure 6:
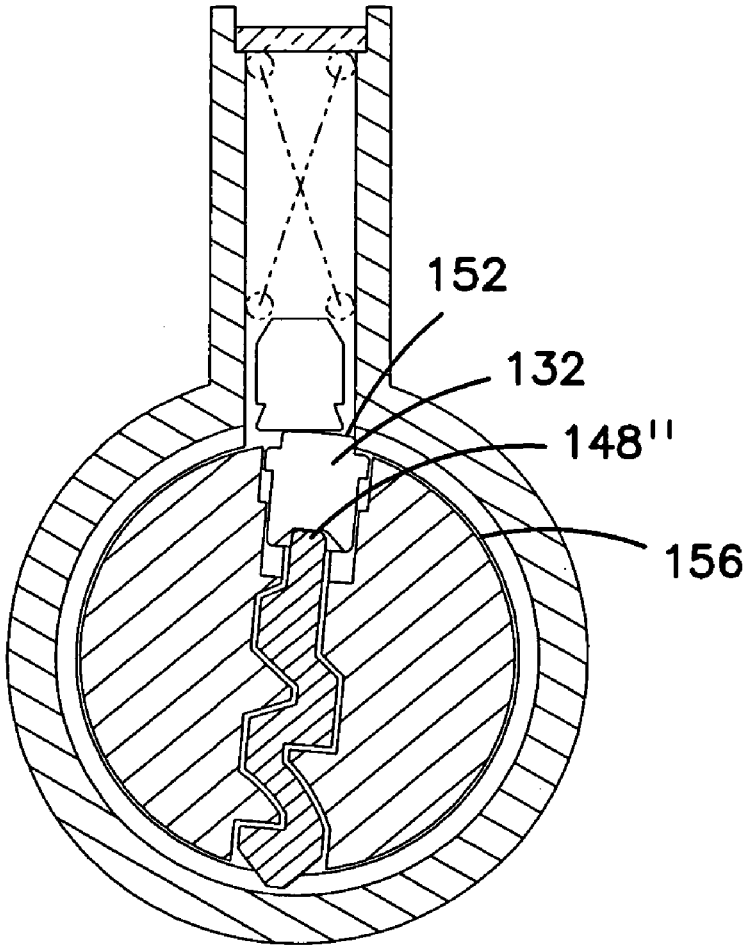
FIG. 6 is a cross sectional view of the lock of FIG. 2, but with a second type of improperly milled key rotated slightly clockwise, whereby the shear line is crossed, thereby preventing further rotation and trapping the key
Figure 9:
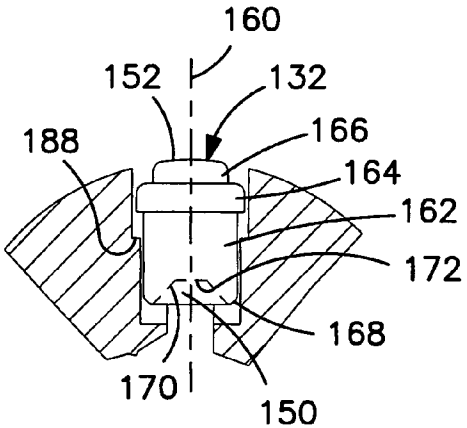
FIG. 9 is an elevation view of the hollow pin that interacts with the projecting compound cam on the key of FIG. 8.

As seen in section through the plug according to FIG. 3, the centerlines of the pins 132, 134 and projection 148 are preferably aligned. As shown in FIGS. 9 and 10, the bottom pin 132 has a cylindrical body 162 of a first outer diameter, an annular flange or rim 164 forming a shoulder, and a substantially cylindrical head portion 166 having a smaller outer diameter than the body portion. The head portion can be slightly rounded, whereas the bottom portion has a beveled edge 168 leading to a concave wall structure defining a recess or cavity 150. The recess could have any shape, even if irregular, that performs the functionality described herein. However, a cavity defining a hollow space that is two-way and preferably four-way symmetric about the pin centerline, most preferably in the shape of a truncated cone (frustoconical) is desirable, wherein the side surface 170 of the cavity forms an angle with the pin centerline, and the end wall 72 is substantially perpendicular to the centerline. Alternatively, no flange need be provided, if the pin body and associated chamber interact as shown in the incorporated U.S. Pat. No. 5,016,455.

Figure 7:
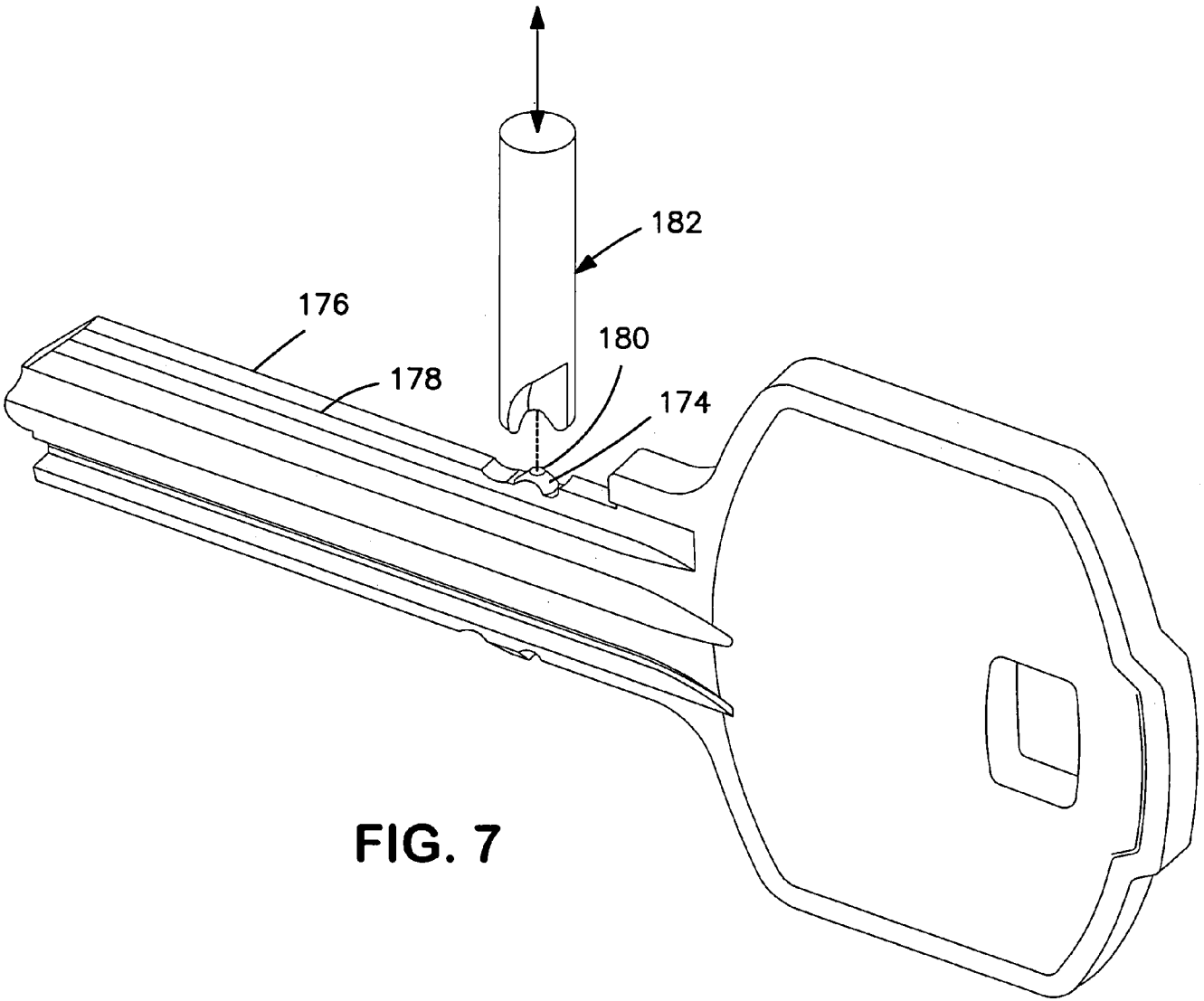
FIG. 7 is a perspective view of a key blank having the projecting compound cam according to the invention.
Figure 8:
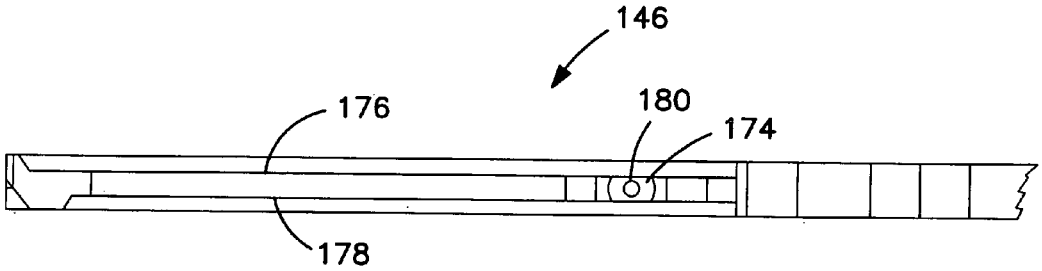
FIG. 8 is a view of the top edge of the key of FIG. 7.
Figure 10B:
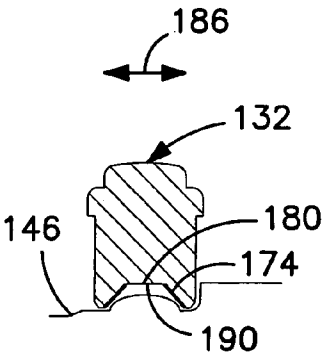
FIGS. 10A and 10B are partially sectioned views of the cam projection of the key situated within the cavity of the pin of FIG. 9, taken along two planes that are perpendicular to each other.
Figure 10A:
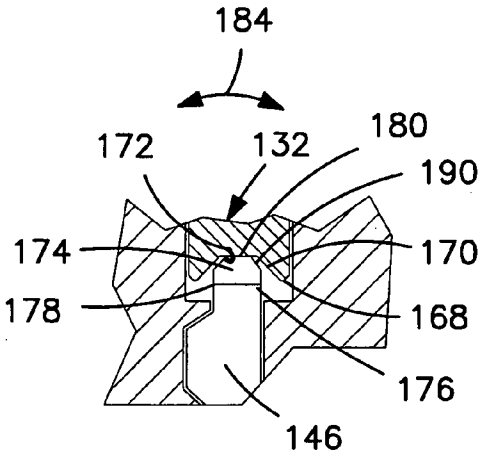

The projection 148 from the top edge of the key forms a compound convex profile, as shown in FIGS. 7, 8 and 10. The base portion 174 of the projection is preferably defined by a substantially hemispherical, convex shape that is linearly truncated by the two parallel longitudinal corners 176, 178 of the top edge of the key. The central portion 180 of the projection is preferably flat. The longitudinal profile 174 as shown in FIG. 10B acts as a cam for the key to pass under the pin 132, whereas the transverse profile 190 as shown in FIG. 10A defines the shoulders of a narrowing, nose-like feature of the projection that can provide a transverse camming action to assure that the projection will enter into and fit within the cavity, even if there is slight misalignment of the center of the projection relative to the center of the pin 132.

The inventive arrangement may optionally include the lower projection 50 on the key and the associated groove in the shell, as shown in FIG. 1. The projection 50 is provided with an angled surface on the side that faces the blade tip and with cam surfaces on the two sides that face in the opposite directions of key rotation. The shape of the angled side of projection 50 which faces the blade tip is complementary to the angled, rearwardly disposed side of groove 44. Since projection 50 functions to retain the key in the keyway when the plug has been rotated from the locked position, in the disclosed embodiment projection 50 is provided with a flat surface on the side which faces the bow 56 of the key. This flat surface 54 which need not be provided on projection 48 since projection 48 does not extend into grove 44, cooperates with the front radially extending shoulder 52 which in-part defines the groove 44. This cooperation results from the fact that projection 50 on the key blade is of greater height than projection 48. Restated, projection 50 is longer than the width, in the radial direction, of increased diameter portion 38 of plug 10 and projection 50 thus extends outwardly from the plug into the groove 44 in the shell. It is also to be noted that the lower portion 58 of the keyway, which accepts projection 50, may be of increased width when compared to the portion of the keyway which accepts the remainder of blade 47.

The preferred key and lock combination of the present invention provides two distinct key retention techniques, which operate in the following manner. Similarly to the known technique according to FIG. 1, upon insertion of a proper key 146 in the keyway 20, all of the pin tumbler stacks, including the auxiliary pin tumbler stack, will be translated to the positions shown in FIG. 2 where the shear lines between the driver and bottom pins register with the shear lines between the plug and shell. This unlocks the lock and permits rotation of the plug relative to the shell. During such rotation the forward facing surface on projection 50 on the key blade cooperates with the front shoulder of groove 44 to retain the key in the lock. When the plug has been rotated 180 degrees, the projection 50 will contact the substantially flat or slightly rounded solid lower surface of auxiliary driver pin 134 and will keep this pin in the raised position where it is shown in FIG. 2. If projection 50 were not present, when the plug was rotated by 180 degrees the lower end 37 of driver pin 34 would be forced by biasing spring 36 into the portion 58 of keyway 20 which extends through enlarged diameter portion 38 of the plug and any further rotation of the key, in either direction, would be prevented. Also, since the bottom pin tumblers could not move outwardly, the key would be trapped.

The present invention provides security and an additional (or optionally alternative) key retention technique. The neutral position of the auxiliary stack resulting from insertion of a proper key 146 in the lock, is shown in FIG. 3. The second portion of the plug and the second portion of the shell are annularly spaced apart by a radial clearance and the shear line between the auxiliary drive pin and the auxiliary bottom pin is within this clearance when the pins are in substantial alignment. Throughout rotation of the plug to the position shown in FIG. 4, the drive pin 134 remains supported by the top surface 152 of the bottom pin until support is transferred to the circumference of the plug, thereby keeping the shear line clear so that the plug may be further rotated to the unlocked position. However, if the projection on the key is too low, as shown at 148' in FIG. 5, the drive pin 134 drops below the shear line 156 into the plug, thereby blocking further rotation of the plug. Similarly, if the projection on the key is too high, as shown at 148" in FIG. 6, the top surface 152 of bottom pin 132 remains above the shear line 156, likewise blocking further rotation of the plug. In the normal condition where rotation is permitted, when the pins 132, 134 are out of substantial alignment as a result the relative rotation between the plug and shell, the inside surface of the second portion of the shell provides a stop limit on the radial displacement of the bottom pin 132 such that the key projection 180 cannot be fully withdrawn from the recess 150 in the bottom pin. In particular, the depth of the recess should be greater than the radial clearance between the plug and shell, so the projection 180 cannot be pulled out of the recess unless the auxiliary pins are substantially aligned.

FIG. 9 shows the exterior of the bottom pin in relation to the surrounding bore in the plug, and FIG. 10A shows a detailed view of the projection nose 180 properly mated with the cavity 150 in the bottom pin 132 (in a vertical section taken perpendicularly to the view of FIG. 9). The end wall 172 of the projection bears on the nose 180, whereas the bottom edges of the pin are slightly suspended above the base portion 174 of the projection. The nose is substantially circular, and defines a flat surface parallel to the key top edge. Alternatively, the outer edges 168 could rest on the base 174 or in the region of the edge surrounding the base without the nose 180 contacting the end wall 172 so long as the projection 148 is within the cavity a greater distance than the clearance between the plug and shell. When the key is rotated as indicated by directional arrow 184, the nose projection 148 remains in the cavity and as the plug carries the bottom pin along by imparting the rotational force on the flange 164 and/or body 162. FIG. 10B is a vertical section corresponding to FIG. 9, with the longitudinal direction (i.e., direction of key insertion and removal) indicated by arrow 186. With no key in the keyway, the flange 164 rests on ledge 188 formed at the counterbore limit of the bottom pin bore. The exterior beveling 168 provides a lead-in ramp for the convex base 174 of key projection 148 to initially raise the bottom pin 132 and then enter and seat against the end wall of the cavity 150 and, in essence, form a detent.

Preferably, the longitudinal dimension of the projection (profile 174) is less than the inner diameter of the cavity 150, so the projection can be received entirely within the cavity, or else the projection can have a longer base profile and projecting nose, with the outer edge of the cavity resting on a portion of the base and the nose entirely within the cavity (not shown). In FIG. 10B, the slopes of the longitudinal profile 174 have approximately the same angle as the angle of the cavity sidewall 170, and are slightly spaced from the sidewall but the pin 132 is vertically supported at the nose 180. As used herein, "detent" means the presence of all or part of a projection on one member into all or part of a recess in another member, whether or not seated. As used herein, "seating" is the condition wherein the projection bears against all or a portion of the inside of the recess.

It can be appreciated that the projection 148 preferably has a compound convex shape as viewed transversely between corners 176, 178 of the blade per FIG. 10A and longitudinally per FIG. 10B. However, other shapes that provide the desired longitudinal camming action may be used, even if the preferred transverse camming action is not provided.

FIG. 7 schematically shows how a milling tool 182 is applied to the upper edge of a key blank to form the compound convex projection having base portion 174 and nose portion 180, in a single, precise milling operation. The top of the nose 180 is at the same elevation as the top edge of the key blank, but after the key is coded with, e.g., a saw tooth bitting pattern (see FIG. 2), the top of the nose 180 will be the highest point on, or above, the top edge out to the tip of the blade.

When the user has locked or unlocked the lock and begins to remove the key from the keyway, the profile of the profile 174 of projection 148 as viewed along directional arrow 186 interacts with the slope of the cavity sidewalls 170 such that the sidewalls ride over the nose 180, whereby the projection 148 can be fully shifted away from the bottom pin 132. The bitting on the remainder of the top surface of the key will not enter the cavity because the greater diameter of the auxiliary shear line and the position of the ledge 188 keep bottom pin high enough above the top edge of the key (key blank) such that even the highest point on any bit will either not contact the lower end of the bottom pin, or will ride on the external beveled edge 168 and sloped internal edge of the cavity. The slopes on the bitting can optionally be substantially equal to the slope of the cavity internal sidewall 170 so the bitting can enter the cavity a substantial distance yet slide past.

Unlike the interaction between the bottom 32 and drive 34 pins in the known configuration represented by FIG. 1, however, the present invention provides for key retention by the auxiliary stack. With reference again to FIGS. 2, 3, and 4, it can be appreciated that shear line 156 between the drive pin 134 and bottom pin 132 exists only when the bottom pin 132 is fully or partially beneath the drive pin bore. With a proper key inserted, the plug can be rotated to operate the latch (not shown), whereby the top 152 of the bottom pin will closely confront the inner solid surface of the shell. If the user attempts to remove the key, the sidewall of the cavity will ride up on the nose, to contact the shell inner surface, which serves as a stop limit on the rise of the bottom pin. Unless the pin can rise a distance exceeding the height of the nose, the cavity entraps the nose, so the key cannot be further pulled out of the keyway. Only by counter rotating and realigning the bottom pin with the drive pin, can the bottom pin rise a sufficient distance to permit the sidewall to completely ride over the nose so the key can be removed.

Although the projection 50 of the incorporated patent provides a key retention function, this is achieved by the projection remaining in a groove 44 having a front shoulder 52 that prevents removal of the key unless the plug is in the neutral position so the projection aligns with slot 58. In contrast, with the present invention no special retention groove is necessary; rather, a detent-like interference is maintained between the projection 148 on the key and the cavity 150 in the underside of the bottom pin 132, for every rotational position of the plug except neutral. The retention function of the lower projection can be eliminated, or augmented. In this embodiment, the projection 148 can extend from the key upper edge a greater distance than the projection 50 extends from the lower edge.

Figure 11:
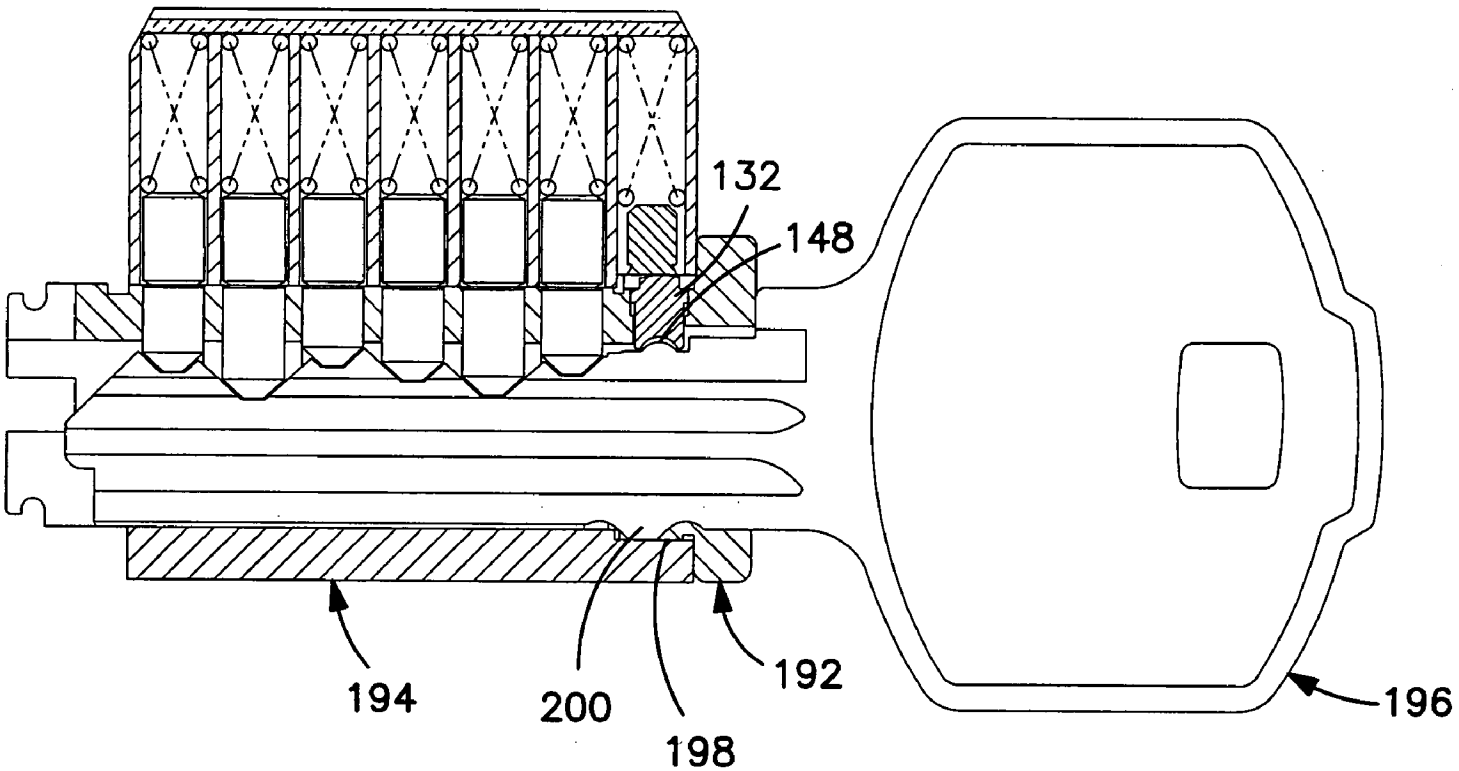
FIG. 11 is view similar to FIG. 2, showing an alternative embodiment wherein the key retention function is achieved only with the inventive auxiliary stack and associated cam projection on the top of the key blade.

FIG. 11 shows an alternative embodiment wherein the groove and associated key retention functionality of the lower projection are eliminated. The plug 192 and associated bottom auxiliary pin 132 can be the same as in the previously described embodiment. However, the shell 194 has a smooth bore wall 198 at the larger diameter associated with the auxiliary stack. The lower projection 200 on key 196 rides on this diameter. There is no resistance provided by the lower projection 200, to removal of the key at any rotational position. Only the retentive function of the upper projection 148 in conjunction with the recess in pin 132, retains the key at all rotational positions except the initial, neutral position.

While a preferred embodiment has been shown for purposes of illustration, various modifications may be made thereto without departing form the spirit and scope of the invention. Accordingly, the present invention has been described by way of illustration and not limitation.

What is claimed is:

1. A lock system comprising:

a key comprising a bow portion and a blade which longitudinally extends from said bow portion to a tip, said blade having a pair of spaced parallel top and bottom edges which are interconnected by opposed side faces, said blade being provided with surface irregularities which define the key bitting, and a rigid camming projection transversely extending from one edge;

a shell having a longitudinal axis, said shell including a first cylindrical portion having a first diameter, at least a first row of primary pin tumbler receiving chambers being located in said first portion, said shell having a second cylindrical portion which is also coaxial with said first portion, said second portion having a second diameter which is greater than said first diameter, an auxiliary pin tumbler receiving chamber being provided in said second portion;

a plug rotatably mounted in said shell, said plug having a face and further having a longitudinally extending keyway formed therein, said keyway having a first portion in registration with said shell first portion and a second portion in registration with said shell second portion, said keyway second portion opening through said face and extending into registration with said shell second portion, said plug also having first and second cylindrical portions of different diameter which are generally complementary to and received in said shell first and second portions, said plug defining at least a first row of primary pin tumbler receiving chambers in said first portion thereof, said first row of primary pin tumbler receiving chambers being alignable with said shell primary pin tumbler receiving chambers, said plug defining an auxiliary pin tumbler receiving chamber in said second portion thereof, said auxiliary pin tumbler receiving chamber being alignable with said shell auxiliary pin tumbler receiving chamber, first and second shear lines respectively being defined between said shell and said plug first and second portions; and pin tumblers reciprocally mounted in said receiving chambers, said pin tumblers each including at least a bottom pin and a driver pin, said pin tumblers including biasing means for urging a pin of each of said pin tumblers to a position of bridging a shear line when a key is not present in said keyway, insertion of a properly bitted key into the keyway displacing said pin tumbler against associated biasing means whereby the interface between the bottom and driver pins is located on a shear line, the underside of the auxiliary bottom pin defining a cavity, the displacement of the pin tumbler positioned in said auxiliary pin tumbler receiving chamber being caused by contact with the camming projection of the inserting key such that the auxiliary bottom tumbler rises along the projection and the proper shear line between the auxiliary bottom pin and the auxiliary driver pin is established when the projection enters and remains in the cavity to form a detent;

whereby rotation of said plug relative to said shell is permitted by said pin tumbler displacement, but withdrawal of said key subsequent to said relative rotation is prevented by the detent formed between the cavity of the auxiliary bottom pin and the projection.

2. The lock system of claim 1, wherein the auxiliary bottom pin is rigid;

the second portion of the plug and the second portion of the shell are annularly spaced apart by a radial clearance;

the cavity in said bottom pin has a depth that is greater than said radial clearance;

the shear line between the auxiliary drive pin and the auxiliary bottom pin is within said clearance when the pins are in substantial alignment; and when the pins are out of substantial alignment as a result of said relative rotation, the detent is maintained in that the second portion of the shell provides a stop limit on the radial displacement of the bottom pin such that the key projection cannot be fully withdrawn from the cavity.

3. The lock system of claim 1, wherein the key projection has opposed longitudinal cam surfaces which converge toward a nose.

4. The lock system of claim 3, wherein the nose is a flat surface parallel to the top edge of the key.

5. The lock system of claim 1, wherein the key projection has a length along the edge that is greater than a width transverse to the edge, and has opposed longitudinal cam surfaces which converge toward a nose and opposed transverse cam surfaces which converge toward said nose.

6. The lock system of claim 5, wherein the nose is a flat surface parallel to the top edge of the key.

7. The lock system of claim 1, wherein the cavity is surrounded by an external beveled rim.

8. The lock system of claim 1, wherein the cavity is frustoconical, having an angled side wall and an internal end wall.

9. The lock system of claim 8, wherein the cavity is surrounded by an external beveled rim.

10. The lock system of claim 8, wherein the key projection has a length in the key longitudinal direction and the length of the projection is less than the maximum diameter of the frustoconical cavity.

11. The lock system of claim 2, wherein the key projection has opposed longitudinal cam surfaces which converge toward a nose and opposed transverse cam surfaces which converge toward said nose.

12. The lock system of claim 11, wherein the nose is a flat circular surface parallel to the top edge of the key.

13. The lock system of claim 11, wherein the cavity is frustoconical, having an angled side wall and an internal end wall.

14. The lock system of claim 13, wherein the cavity is surrounded by an external beveled rim.

15. The lock system of claim 13, wherein the key projection has a length in the key longitudinal direction and the length of the projection is less than the maximum diameter of the frustoconical cavity.

16. The lock system of claim 15, wherein when the projection is in the detent condition, said nose seats against said end wall.

17. The lock system of claim 11, wherein the chamber for the auxiliary driver pin has the same diameter as the chambers for the other driver pins and the chamber for the bottom auxiliary pin has the same diameter as the chambers for the other bottom pins, but the auxiliary driver pin has a smaller diameter than the diameters of the other driver pins.

18. The lock system of claim 17, wherein the chamber for the auxiliary driver pin has a driver centerline and the chamber for the auxiliary bottom pin has a bottom centerline that is offset from the driver centerline in the direction of the plug face, whereby the chambers are aligned but not concentric.

19. The lock system of claim 2, wherein the chamber for the auxiliary driver pin has a driver centerline and the chamber for the auxiliary bottom pin has a bottom centerline that is offset from the driver centerline in the direction of the keyway, whereby the chambers are aligned but not concentric.

20. The lock system of claim 2, wherein said projection is at the top edge of the key and the key has another projection on the bottom edge in substantial alignment with said projection, said other projection being substantially flush with the cylindrical surface of said second portion of the plug.

21. A lock system comprising:

a key comprising a bow portion and a blade which longitudinally extends from said bow portion along a key centerline to a tip, said blade having a pair of spaced parallel top and bottom edges which are interconnected by opposed side faces, said blade being provided with surface irregularities which define the key bitting, a shaped rigid camming projection transversely extending from each of said edges, said projections being at least in part in alignment, a second of said projections extending outwardly a greater distance from said centerline when compared to the oppositely disposed first projection;

a shell having a longitudinal axis, said shell including a first cylindrical portion having a first diameter, at least a first row of primary pin tumbler receiving chambers being located in said first portion, said shell having a second cylindrical portion which is also coaxial with said first portion, said second portion having a second diameter which is greater than said first diameter, an auxiliary pin tumbler receiving chamber being provided in said second portion, said shell further having a circumferential groove intermediate the ends of said second portion, said auxiliary pin tumbler receiving chamber intercepting said groove;

a plug rotatably mounted in said shell, said plug having a face and further having a longitudinally extending keyway formed therein, said keyway having a first portion in registration with said shell first portion and a second portion in registration with said shell second portion, said keyway second portion opening through said face and extending into registration with said shell second portion, said plug also having first and second cylindrical portions of different diameter which are generally complementary to and received in said shell first and second portions, said plug defining at least a first row of primary pin tumbler receiving chambers in said first portion thereof, said first row of primary pin tumbler receiving chambers being alignable with said shell primary pin tumbler receiving chambers, said plug defining an auxiliary pin tumbler receiving chamber in said second portion thereof, said auxiliary pin tumbler receiving chamber being alignable with said shell auxiliary pin tumbler receiving chamber, first and second shear lines respectively being defined between said shell and said plug first and second portions; and pin tumblers reciprocally mounted in said receiving chambers, said pin tumblers each including at least a bottom pin and a driver pin, said pin tumblers including biasing means for urging a pin of each of said pin tumblers to a position of bridging a shear line when a key is not present in said keyway, wherein the auxiliary bottom pin has a recessed underside, and insertion of a properly bitted key into the keyway displaces said pin tumblers against associated biasing means whereby the interface between the bottom and driver pins is located on a shear line, the displacement of the pin tumbler positioned in said auxiliary pin tumbler receiving chambers to establish the shear line being caused by camming of the first projection against the underside of the auxiliary bottom pin until entry of the first projection within said recess to a detent condition, rotation of said plug relative to said shell being permitted by said pin tumbler displacement, the other of said key blade edge projections travelling in said shell groove during such relative rotation, whereby withdrawal of said key subsequent to said relative rotation is prevented by interference between said second projection and a side wall of said shell groove and by the recess of the auxiliary bottom pin retaining the first projection.

22. The lock system of claim 21, wherein the auxiliary bottom pin is rigid;

the second portion of the plug and the second portion of the shell are annularly spaced apart by a radial clearance;

the recess in said bottom pin has a depth that is greater than said radial clearance;

the shear line between the auxiliary drive pin and the auxiliary bottom pin is within said clearance when the pins are in substantial alignment; and when the pins are out of substantial alignment as a result of said relative rotation, the retention of the first projection is maintained in that the second portion of the shell provides a stop limit on the radial displacement of the bottom pin such that the key projection cannot be fully withdrawn from the recess.

23. The lock system of claim 21, wherein the first projection has opposed longitudinal cam surfaces which converge toward a nose.

24. The lock system of claim 23, wherein the nose is a flat surface parallel to the top edge of the key.

25. The lock system of claim 21, wherein the first projection has a length along the edge that is greater than a width transverse to the edge, and has opposed longitudinal cam surfaces which converge toward a nose and opposed transverse cam surfaces which converge toward said nose.

26. The lock system of claim 25, wherein the nose is a flat surface parallel to the top edge of the key.

27. The lock system of claim 21, wherein the recess is surrounded by an external beveled rim.

28. The lock system of claim 21, wherein the recess is a frustoconical cavity, having an angled side wall and an internal end wall.

29. The lock system of claim 28, wherein the cavity is surrounded by an external beveled rim.

30. The lock system of claim 28, wherein the first projection has a length in the key longitudinal direction and the length of the projection is less than the maximum diameter of the frustoconical cavity.

31. In a lock comprising:

a shell having a longitudinal axis, said shell including a first cylindrical portion having a first diameter, at least a first row of primary pin tumbler receiving chambers being located in said first portion, said shell having a second cylindrical portion which is also coaxial with said first portion, said second portion having a second diameter which is greater than said first diameter, an auxiliary pin tumbler receiving chamber being provided in said second portion;

a plug rotatably mounted in said shell, said plug having a face and further having a longitudinally extending keyway formed therein, said keyway having a first portion in registration with said shell first portion and a second portion in registration with said shell second portion, said keyway second portion opening through said face and extending into registration with said shell second portion, said plug also having first and second cylindrical portions of different diameter which are generally complementary to and received in said shell first and second portions, said plug defining at least a first row of primary pin tumbler receiving chambers in said first portion thereof, said first row of primary pin tumbler receiving chambers being alignable with said shell primary pin tumbler receiving chambers, said plug defining an auxiliary pin tumbler receiving chamber in the said second portion thereof, said auxiliary pin tumbler receiving chamber being alignable with said shell auxiliary pin tumbler receiving chamber, first and second shear lines respectively being defined between said shell and said plug first and second portions; and pin tumblers reciprocally mounted in said receiving chambers, said pin tumblers each including at least a rigid bottom pin and a confronting, rigid driver pin, said pin tumblers including biasing means for urging a driver pin of each of said pin tumblers to a position of bridging a shear line when a key is not present in said keyway, insertion of a properly bitted key into the keyway displacing said pin tumbler against associated biasing means whereby the confronting interface between the bottom and driver pins is located on a shear line;

the improvement wherein the auxiliary bottom pin has an underside facing said keyway and said underside is recessed.

32. The lock of claim 31, wherein the second portion of the plug and the second portion of the shell are annularly spaced apart by a radial clearance;

the recess in said bottom pin has a depth that is greater than said radial clearance; and the shear line between the auxiliary driver pin and the auxiliary bottom pin is within said clearance when the pins are in substantial alignment.

33. The lock of claim 31, wherein the recess is four way symmetric;

the chamber for the auxiliary driver pin has the same diameter as the chambers for the other driver pins and the chamber for the bottom auxiliary pin has the same diameter as the chambers for the other bottom pins, but the auxiliary driver pin has a smaller diameter than the diameters of the other driver pins;

the chamber for the auxiliary driver pin has a driver centerline and the chamber for the auxiliary bottom pin has a bottom centerline that is offset from the driver centerline in the direction of the plug face, whereby the chambers are aligned but not concentric.

34. The lock of claim 31, wherein the recess is frustoconical, having an angled side wall and an internal end wall.

35. The lock of claim 31, wherein the recess is surrounded by an external beveled rim.

36. The lock of claim 32, wherein the recess is frustoconical, having an angled side wall and an internal end wall.

37. The lock of claim 36, wherein the recess is surrounded by an external beveled rim.

38. A key blank for a cylinder lock comprising:

a bow;

a blade longitudinally extending from said bow to a tip, and having a pair of longitudinally extending oppositely disposed and spaced edges, and side faces which connect said edges, one of said edges to be cut with bitting; and a projection extending outwardly to a nose, on each of said oppositely disposed edges, said projections being at least in part in alignment, one of said projections, extending from the edge to be cut, having a nose closer to the bow than the nose of the other projection, a length parallel to the edge that is greater than a width transverse to the edge and a compound convex cam profile, wherein said one projection as viewed from above the edge, presents a convexly contoured surface facing the tip of the blade.

39. The key blank of claim 38, wherein said one key projection has opposed longitudinal cam surfaces which start at a base below the edge and converge toward said nose.

40. The key blank of claim 39, wherein the nose is a flat surface parallel to an edge of the key.

41. The key blank of claim 38, wherein said one projection has opposed longitudinal cam surfaces which converge toward said nose and opposed transverse cam surfaces which converge toward said nose.

42. The key blank of claim 41, wherein the nose is a flat circular surface parallel to an edge of the key.

43. The key blank of claim 42, wherein said one projection is adjacent the bow.

44. A key blank for encoding to operate a coded lock of the type comprising:

a shell having a longitudinal axis, said shell including a first cylindrical portion having a first diameter, at least a first row of primary pin tumbler receiving chambers being located in said first portion, said shell having a second cylindrical portion which is also coaxial with said first portion, said second portion having a second diameter which is greater than said first diameter, an auxiliary pin tumbler receiving chamber being provided in said second portion;

a plug rotatably mounted in said shell, said plug having a face and further having a longitudinally extending keyway formed therein, said keyway having a first portion in registration with said shell first portion and a second portion in registration with said shell second portion, said keyway second portion opening through said face and extending into registration with said shell second portion, said plug also having first and second cylindrical portions of different diameter which are generally complementary to and received in said shell first and second portions, said plug defining at least a first row of primary pin tumbler receiving chambers in said first portion thereof, said first row of primary pin tumbler receiving chambers being alignable with said shell primary pin tumbler receiving chambers, said plug defining an auxiliary pin tumbler receiving chamber in the said second portion thereof, said auxiliary pin tumbler receiving chamber being alignable with said shell auxiliary pin tumbler receiving chamber, first and second shear lines respectively being defined between said shell and said plug first and second portions; and pin tumblers reciprocally mounted in said receiving chambers, said pin tumblers each including at least a bottom pin and a driver pin, said pin tumblers including biasing means for urging a pin of each of said pin tumblers to a position of bridging a shear line when a key is not present in said keyway, wherein the auxiliary bottom pin has an underside facing said keyway and said underside is recessed;

whereby insertion of a properly bitted key into the keyway displaces said pin tumblers against associated biasing means such that the interfaces between all the bottom and driver pins are located on a shear line;

wherein said key blank comprises a bow;

a blade longitudinally extending from said bow to a tip and having a pair of longitudinally extending oppositely disposed and spaced edges, one of said edges to be cut with bitting for matching the coding of the primary tumbler stack, and side faces which connect said edges; and a camming projection interrupting the edge to be cut, and located adjacent the bow thereby forming a front edge portion to be cut and a back edge portion adjacent the bow, said projection rising from respective bases below the front and back edge portions to a nose, with the back edge portion higher than the front edge portion, a length parallel to the edge that is greater than a width transverse to the edge, and having a compound convex cam profile for facilitating entry of the projection into the recess of the auxiliary pin of said lock as the key is fully inserted in the keyway of said lock.

45. The key blank of claim 44, wherein said compound convex profile has opposed machined longitudinal cam surfaces which converge toward the nose and opposed transverse cam surfaces which converge toward said nose.

46. The key blank of claim 45, wherein the projection as viewed along the edge toward the bow, has a substantially constant width between parallel sides rising from the base, which then contours inwardly toward the nose.

47. The key blank of claim 45, wherein the projection as viewed from above, presents a convexly contoured surface facing the edge, from the base to the nose.

* * * * *

UNITED STATES PATENT AND TRADEMARK OFFICE

CERTIFICATE OF CORRECTION

PATENT NO. : 7,181,941 B2
APPLICATION NO. : 10/909567
DATED : February 27, 2007
INVENTOR(S) : Eden, Jr.

It is certified that error appears in the above-identified patent and that said Letters Patent is hereby corrected as shown below:

Column 14:

Line 26, delete “key”.

Signed and Sealed this

Sixth Day of November, 2007

JON W. DUDAS
*Director of the United States Patent and Trademark Office*